United States Patent [19]

Yerger

[11] 4,375,337

[45] Mar. 1, 1983

[54] UNDERWATER DEVICE FOR RUFFLING STILL WATER

[76] Inventor: Joseph W. Yerger, 1403 Johnson St., P.O. Box 709, Tallulah, La. 71282

[21] Appl. No.: 247,217

[22] Filed: Mar. 24, 1981

[51] Int. Cl.[3] ..... B01F 13/00; E04H 3/18

[52] U.S. Cl. ..... 366/343; 4/491; 43/3

[58] Field of Search ..... 366/343, 279, 241, 282, 366/331, 349, 601; 310/58, 62, 63, 85; 43/3; 4/491; 272/26, 32; 318/16; 340/539

[56] References Cited

U.S. PATENT DOCUMENTS 1,800,530 4/1931 Hoskinson ..... 4/491

2,558,434 6/1951 Hofberg ..... 318/16 X 3,350,724 11/1967 Leigh ..... 4/491

3,635,448 1/1972 Okada ..... 4/491

*Primary Examiner*—Edward J. McCarthy

*Attorney, Agent, or Firm*—Frances Richey

[57] ABSTRACT

A small, battery operated, electric motor contained in an underwater waterproof housing operates a submerged propeller in a stationary location for the purpose of creating ripples on the surface of still water. Such ripples in a decoy-spread simulate motion of the decoys to waterfowl flying overhead, and thus create a more lifelike and inviting attraction. The underwater motor may be operated by remote control.

3 Claims, 4 Drawing Figures

FIG. 1.
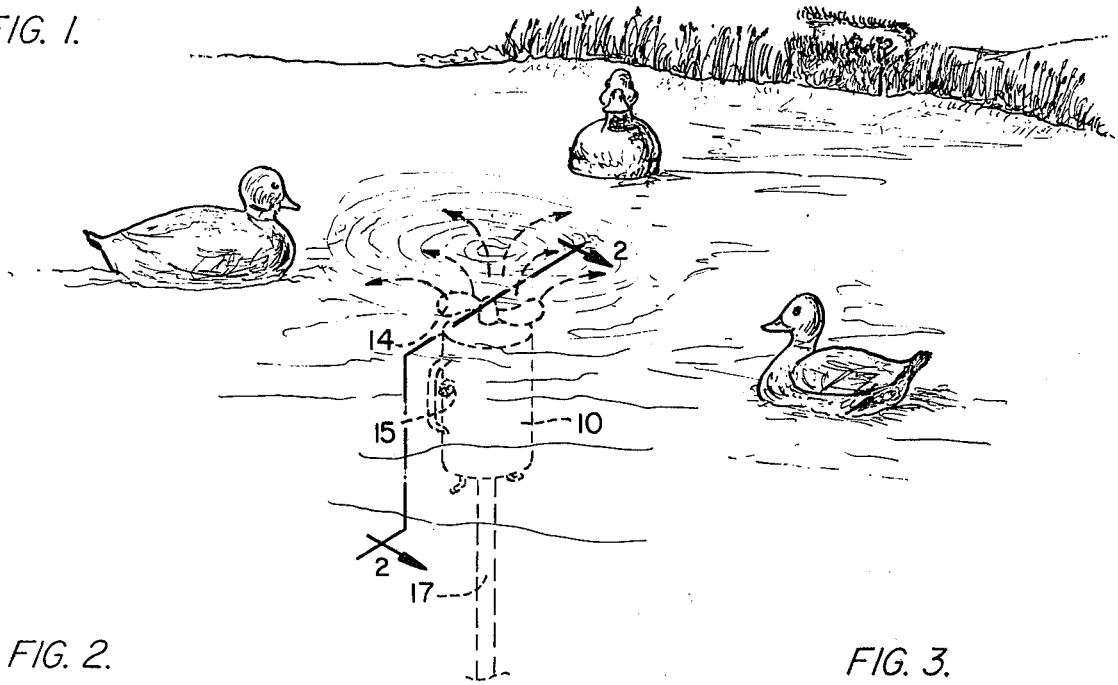
FIG. 2.
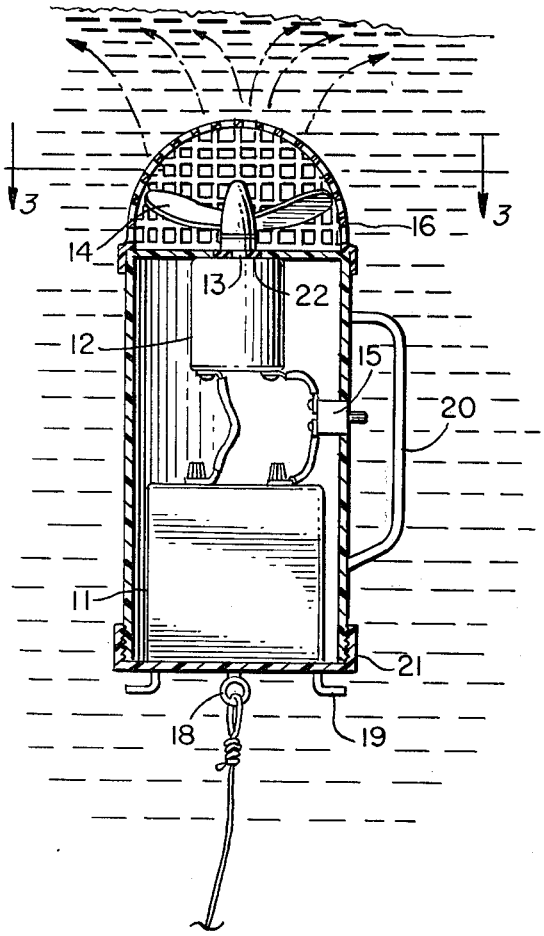
FIG. 3.
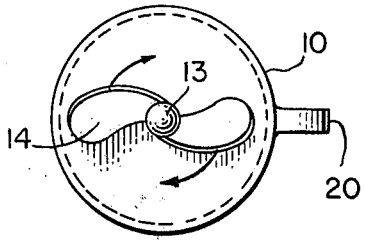
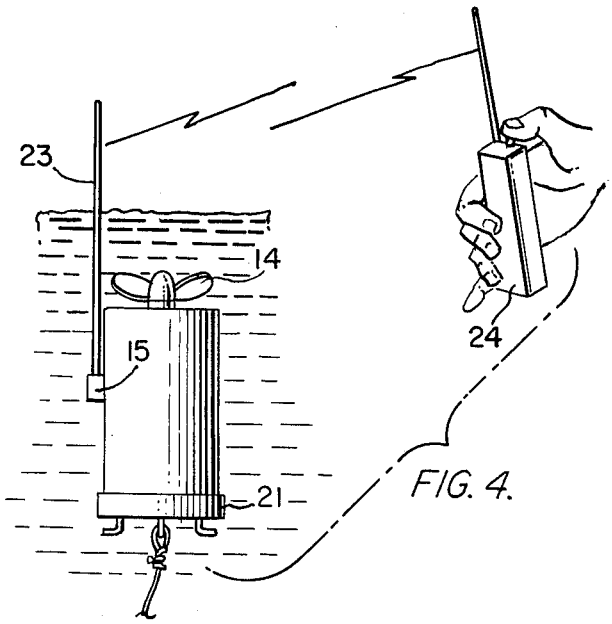
FIG. 4.

UNDERWATER DEVICE FOR RUFFLING STILL WATER

BACKGROUND

This invention, a new use for an old machine, is a device which creates ripples in still water, designed to be carried in the pocket of a hunting vest. It consists of a sealed plastic housing containing a 6-volt rechargeable battery and a 6-volt electric motor. A sealed shaft protrudes from the top of the housing to which is attached a small propeller. A plastic cover, removable in use, is provided. A water-tight threaded screw-on removable bottom provides access to the interior of the housing.

The device is supported by a stake with pointed end, which in shallow water can be stuck in the bottom of the pond, stream, or lake. The length of the pipe is adjustable to conform with the depth of the water. Field tests indicate that the device should be held several inches below the surface of the water for maximum efficiency. In deeper water, an anchor cord attached to a weight can be adjusted to hold the device to the desired depth. Two hooks onto which the anchor cord may be wound when not in use and a handle complete the mechanical structure.

Alternatively the on-off switch may be operated through a receiver connected to an antenna mounted on the housing, such that the receiver can respond to a hand-held transmitter at a remote location.

DESCRIPTION OF THE DRAWINGS

The accompanying drawings form part of the specifications and are to be read in conjunction therewith, and in which like reference numerals are employed to indicate like parts in the various views:

FIG. 1 is a perspective view showing the subject invention in use among a decoy spread.

FIG. 2 is a vertical longitudinal sectional view of the device of FIG. 1 with an alternative protective shield in place.

FIG. 3 is a plan view of the device drawn through the cross-section 3—3 of FIG. 2.

FIG. 4 shows an alternative form of the device illustrating a remote controlled capacity.

Referring to the drawings in greater detail, FIG. 1 illustrates a typical application of the underwater device which is the subject of this invention. The underwater device, to be described in more detail in connection with the description of FIG. 2, has the external appearance of a cylindrical housing 10 mounted on a stake 17 with a switch 15 and, on top of the housing, a propeller 14. When the device is turned on, the propeller causes water to move, resulting in ripples on the water surface as shown. To flying waterfowl, the water motion simulates motion of the decoys as shown.

FIG. 2 shows a housing 10 containing a battery 11, an electric motor 12, a rotatable shaft 13, a propeller 14, an on-off switch 15, a shield 16, a loop 18, to which an anchor cord can be attached, hooks 19 around which the anchor cord may be wrapped when not in use, a handle 20, a watertight threaded screw-on bottom cover 21, and a watertight seal around the rotatable shaft 22.

FIG. 3 shows a plan view of the top of the invention showing the rim of the housing 10, the blade of the propeller 14 which is shown as two-bladed but may be any number of blades, and the propeller shaft 13. A top view of the handle 20 is also shown.

FIG. 4 shows the device in remote control operation with the switch 15 and receiver connected to an antenna 23 and controlled by a remote transmitter 24.

From the foregoing, it will be seen that this invention is one well adapted to attain the ends hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described my invention, I claim:

1. A means whereby still water is caused to have ripples on the surface to simulate waterfowl swimming, comprising a waterproof housing containing a battery, an electric motor connected to and powered by the battery and causing to rotate a rotatable shaft, a propeller connected to the rotatable shaft, a watertight seal around the shaft at the top of the housing, an electrical circuit connecting the motor and battery with an on-off switch mounted such that it is accessible from outside the housing, a watertight threaded screw-on removable bottom for the housing, and a means of positioning the motor assembly a distance below the surface of the water such that ripples simulating the appearance of motion of waterfowl swimming on the surface are created without causing either an audible or a visual signal that would alarm incoming waterfowl in flight, such positioning means comprising a stake of adjustable length attached to the bottom of the housing.

2. The device as described in claim 1 and with a loop fastened to the bottom of the housing to which an anchor line can be attached.

3. A device as in claim 1 or 2 with a receiver coupled to the on-off switch, an antenna connected to the receiver and protruding above the water surface, and a transmitter at a remote location for the purpose of operating the switch.

* * * * *